US008979190B2

(12) United States Patent
Madrigal et al.

(10) Patent No.: US 8,979,190 B2
(45) Date of Patent: Mar. 17, 2015

(54) TRAY WITH ARMREST CLAMP

(71) Applicants: Demetrius Madrigal, San Jose, CA (US); Bryan Ulrich McClain, Foster City, CA (US); Raymond Donald Mueller, Menlo Park, CA (US); Anthony Printis, Clawson, MI (US)

(72) Inventors: Demetrius Madrigal, San Jose, CA (US); Bryan Ulrich McClain, Foster City, CA (US); Raymond Donald Mueller, Menlo Park, CA (US); Anthony Printis, Clawson, MI (US)

( * ) Notice: Subject to any disclaimer, the term of this patent is extended or adjusted under 35 U.S.C. 154(b) by 31 days.

(21) Appl. No.: 14/058,445

(22) Filed: Oct. 21, 2013

(65) Prior Publication Data

US 2014/0110977 A1 Apr. 24, 2014

Related U.S. Application Data

(60) Provisional application No. 61/716,483, filed on Oct. 19, 2012.

(51) Int. Cl.
*A47B 39/00* (2006.01)
*A47B 83/02* (2006.01)
*A47C 7/70* (2006.01)

(52) U.S. Cl.
CPC .. *A47B 83/02* (2013.01); *A47C 7/70* (2013.01)
USPC .... 297/162; 297/161; 297/170; 248/288.51 A

(58) Field of Classification Search
CPC ..... A47C 7/70; A47C 7/68
USPC ..... 297/161, 162, 170; 108/49; 248/288.51
See application file for complete search history.

(56) References Cited

U.S. PATENT DOCUMENTS

| | | | | | |
|---|---|---|---|---|---|
| 2,867,401 | A * | 1/1959 | Sheahan | 248/231.41 |
| 3,265,436 | A * | 8/1966 | La Bombard et al. | 297/162 |
| 3,614,085 | A * | 10/1971 | Cunningham | 5/623 |
| 4,575,149 | A * | 3/1986 | Forestal et al. | 297/145 |
| 4,861,102 | A * | 8/1989 | Fuller | 297/162 |
| 5,630,642 | A * | 5/1997 | Grimmett et al. | 297/145 |
| 5,865,124 | A * | 2/1999 | Wroe | 108/26 |
| 5,909,922 | A * | 6/1999 | Dugas | 297/188.18 |
| 6,142,559 | A * | 11/2000 | Sorel et al. | 297/135 |
| 6,375,257 | B1 * | 4/2002 | Wooding et al. | 297/162 |
| 7,284,735 | B1 * | 10/2007 | Khosropour et al. | 248/226.11 |
| 7,726,732 | B1 * | 6/2010 | Keating | 297/170 |
| 8,056,874 | B2 * | 11/2011 | Goodwin et al. | 248/276.1 |
| 8,256,835 | B2 * | 9/2012 | Brink et al. | 297/162 |
| 2005/0116514 | A1 * | 6/2005 | Bufkin | 297/161 |
| 2008/0302938 | A1 * | 12/2008 | Goodwin et al. | 248/288.51 |
| 2012/0223548 | A1 * | 9/2012 | Sharber et al. | 297/161 |

* cited by examiner

*Primary Examiner* — Laurie Cranmer
(74) *Attorney, Agent, or Firm* — Phillip M. Wagner

(57) ABSTRACT

A tray attached to a pivot housing, support arm, and armrest clamp may be easily and quickly detached and reattached to an armrest on a chair. The tray may rotate around an arm hub when a stationary lower index plate in the arm hub is displaced from an upper index plate in the index housing. The tray is restrained from rotation when the upper and lower index plates are in contact with one another. The tray may be disconnected from the support arm while the support arm remains clamped to an armrest. The armrest clamp includes a bevel gear driven in rotation by a clamping ring on the support arm. The bevel gear drives rack gear attached to a traveling clamp jaw. Rotating the clamping ring displaces the traveling clamp jaw relative to a stationary clamp jaw, enabling the armrest clamp to securely clamp to an armrest.

20 Claims, 12 Drawing Sheets

Fig. 18
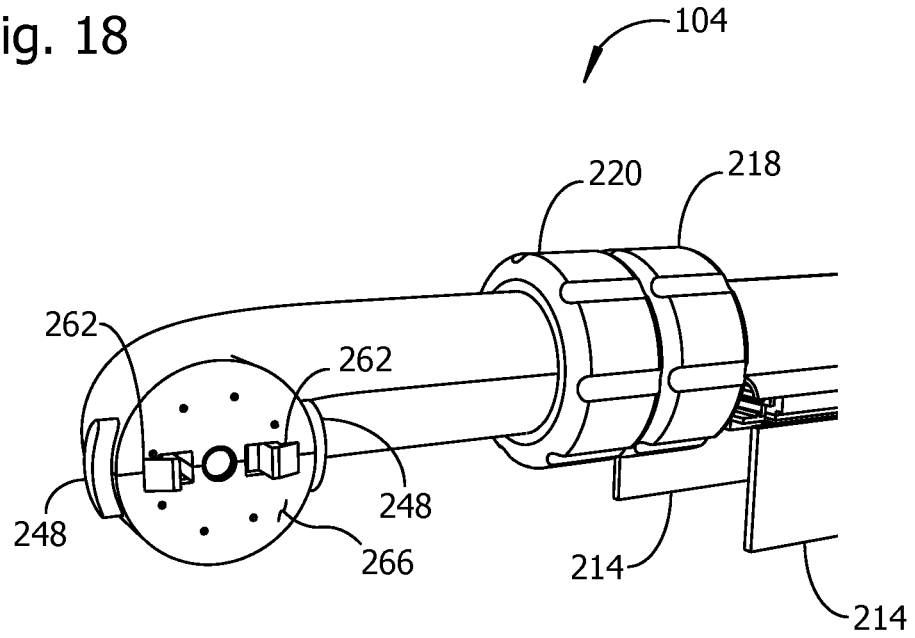
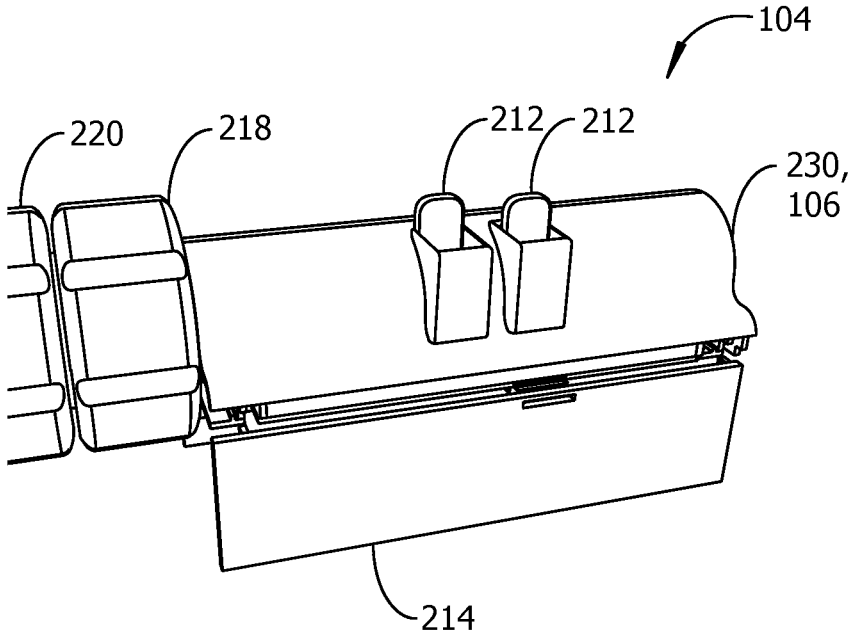
Fig. 19

TRAY WITH ARMREST CLAMP

CROSS REFERENCE TO RELATED APPLICATIONS

This application claims the benefit of U.S. Provisional Application No. 61/716,483, filed Oct. 19, 2012, titled "Tray with Quick Release Clamp", and incorporated herein by reference in its entirety.

FIELD OF THE INVENTION

The present invention relates generally to an adjustable tray having a clamp for secure, removable attachment to an external support such as the armrest of a chair.

BACKGROUND

A tray may be attached to the arms of a chair to provide a convenient surface for holding food or other items within easy reach of a seated person. Some trays span the gap between the armrests on the left and right sides of the chair, attaching to both armrests by straps, spring clips, or clamps. Other trays are rotatably joined to the armrests or sides of a chair by a hinge at either side, enabling the tray to be stowed behind the chair or rotated in front of a seated person. Yet other trays have posts sized for sliding engagement with apertures in the armrests or armrest supports. Airline travelers may be familiar with trays that are joined to a chair by an extendable linkage that permits the tray to be rotated out of the way and stowed in a side of the chair.

Any of these trays have one or more problems which may interfere with a person using the tray. Some trays require a modification of a chair to support the tray and may not attach to unmodified chairs. Other trays are difficult to detach from one chair and attach to a different chair. Some trays are detachable from a chair, but detaching and re-attaching the tray, for example by undoing and redoing straps or clamps, may be too complicated or time-consuming to do each time a person wants to move the tray out of the way, for example to stand up or cross one's legs. Some trays exceed the maximum size of an object permitted to be carried into a public venue such as a sports stadium. Other trays are not suitable for rough handling or exposure to inclement weather. Some trays are not strongly supported enough by a chair to carry a heavy load such as several full beverage cups. Some trays are too large or too heavy for convenient portability, for example by fitting the tray into a tote bag. Some clamping mechanisms used for attaching a tray to a chair may scratch, bend, crush, or cause other damage to part of the chair.

SUMMARY

An example of an embodiment of the invention includes a tray and a pivot housing attached to the tray. The pivot housing includes an arm hub rotatably coupled to the pivot housing. The example of an embodiment of the invention also includes an armrest clamp having a clamping ring, a stationary clamp jaw, and a traveling clamp jaw driven in linear displacement relative to the stationary clamp by rotation of the clamping ring. The embodiment of the invention further includes a support arm having an end cap at a first end of the support arm, a latch extending outward from the end cap, and a tray release pushbutton attached to the latch, wherein the latch holds the arm hub stationary against the end cap, depressing the tray release pushbutton disengages the latch from the arm hub, and disengaging the latch from the arm hub disconnects the pivot housing from the support arm.

An example of a pivot housing may further include a pivot pushbutton, a lower index plate attached to the pivot pushbutton and slidably coupled to the arm hub, and an upper index plate attached to the pivot housing. The lower index plate is restrained from rotating relative to the arm hub. The tray is restrained from rotating relative to the support arm when the lower index plate is in contact with the upper index plate.

The support arm may further include a pivot spring in contact with the pivot pushbutton when the housing is attached to the support arm. The pivot spring urges the pivot pushbutton and the lower index plate toward the upper index plate, thereby holding the lower index plate against the upper index plate and restraining rotation of the tray relative to the support arm.

The armrest clamp may further include an armrest clamp housing, a drive shaft attached to the clamping ring and rotatably coupled to the armrest clamp housing, a first bevel gear attached to a first end of said drive shaft, and a first rack gear slidably coupled to the armrest clamp housing and driven by the first bevel gear, wherein the traveling clamp jaw is attached to the first rack gear and rotation of the clamping ring drives the first bevel gear in rotation and causes the first rack gear to displace the traveling clamp jaw relative to the stationary clamp jaw.

BRIEF DESCRIPTION OF THE DRAWINGS

FIG. 18 is a partial pictorial view toward a first end of an example of a support arm.

FIG. 19 is a partial pictorial view of an end of an example of a support arm and armrest clamp.

DESCRIPTION

Figure 1:
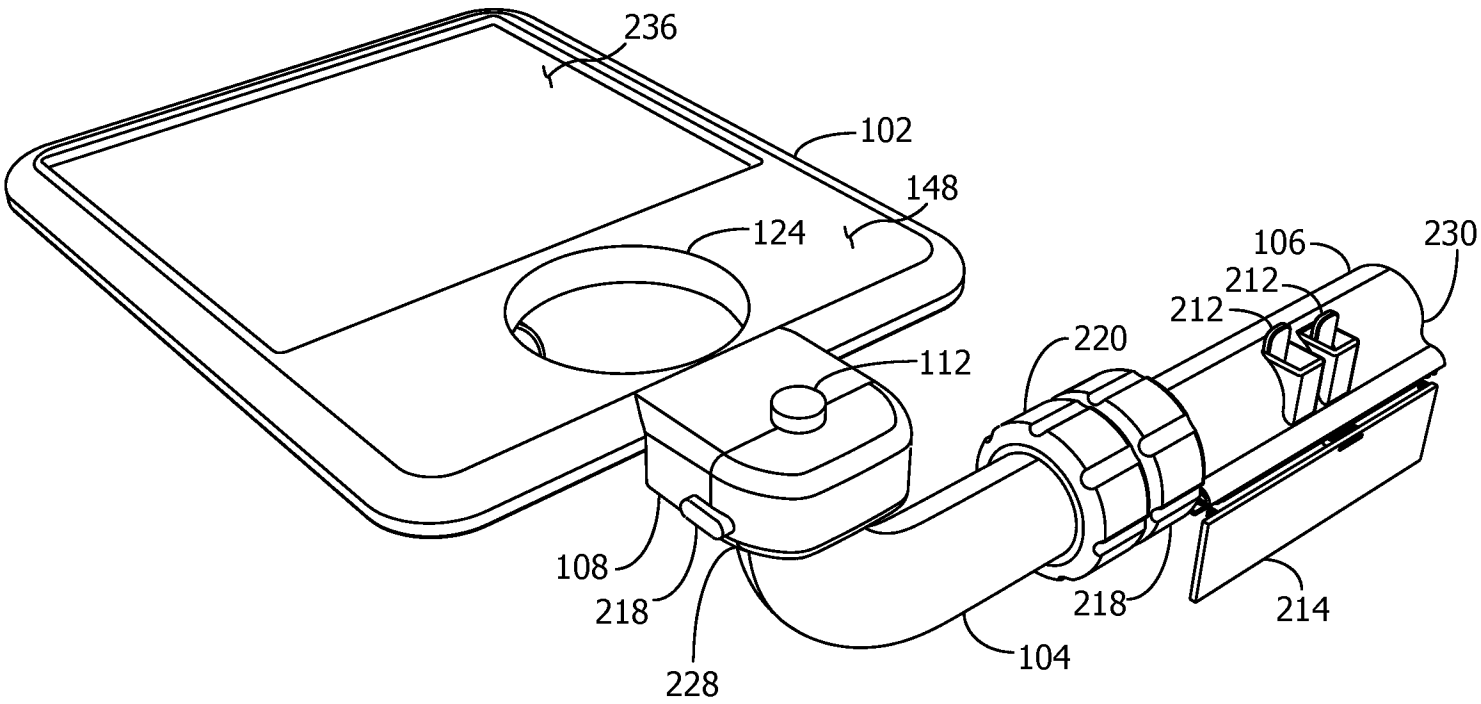
FIG. 1 is a pictorial view of toward the top side of an example of an embodiment of the invention, showing an adjustable tray rotatably coupled to a support arm having an armrest clamp for removably attaching the support arm to an external structure such as the armrest of a chair, and further showing the tray rotated into a deployed position.

Embodiments of the invention comprise a strong, lightweight, portable tray that may be quickly and easily attached to and detached from an external structure such as the armrest of a seat or chair. An embodiment of the invention, also referred to herein as a portable tray assembly, includes an adjustable tray rotatably coupled to an end of a support arm and an armrest clamp attached to an opposite end of the support arm. Trays of different shapes and sizes may optionally be provided with an embodiment of the invention. The armrest clamp securely grips an armrest on a chair without damaging the chair. The armrest clamp may be easily adjusted for a secure hold on an armrest or released from the armrest with one hand. The adjustable tray may be rotated relative to the support arm to position the tray in front of a person for convenient use or swing the tray out of the person's way. The support arm may be extendable, enabling a separation distance between the adjustable tray and a seatback to be varied according to a user's preference. The adjustable tray may be rapidly and easily detached and re-attached to the end of the support arm without removing the support arm from an armrest. The support arm may be stowed against the back side of the adjustable tray for convenient storage and transport of the portable tray assembly.

A stadium seat is an example of an external structure to which an embodiment of the invention may be removably attached. A stadium seat may have a seat bottom which may be folded upward toward the seat back or folded down for a person to sit in the seat. At least two stadium seats may be connected together to form a row of seats. A stadium seat may share an armrest with an adjacent stadium seat. Two adjacent seats may share a leg between the seats. Examples of stadium seats may be found in, for example, baseball parks, football stadiums, and other sports and entertainment venues. Similar seating with shared armrests between adjacent seats may be found in movie theaters and theaters for the performing arts. It will be appreciated that embodiments of the invention may be used with other types of seats or chairs having at least one armrest, or may be used with other structures narrow enough to fit between the jaws of the armrest clamp on the support arm, for example a handrail, fence, seatback, truck tailgate, and so on.

Advantages of the embodiments of the invention include very little intrusion into a space available to be occupied by a person in an adjacent seat with a shared armrest such as a stadium seat, quick and easy repositioning of the adjustable tray to prevent interference with the passage of people walking in front of the seat and to permit a person using the seat to stand up without interference from the adjustable tray, and attachment or removal of the support arm without causing marring, scratches, or other damage to the seat, armrest, or other structures. Further advantages include outer surfaces on the support arm and armrest clamp that are suitable for use as a comfortable armrest when the armrest clamp is attached to the armrest of a chair. Embodiments of the invention provide a convenient, stable surface for holding food, beverage containers, program materials, and other items which a person seated in a stadium chair might otherwise hold in their hands or place on their lap or on an unsanitary surface such as the floor of a stadium or theater.

For discussion purposes herein, directions will be described from the point of view of a person seated in a stadium seat. The floor to which the seat is attached represents a horizontal surface. A left side of a chair or other object is nearest the seated person's left side. A vertical direction is approximately perpendicular to the floor.

An example of a portable tray assembly 100 in accord with an embodiment of the invention is shown in FIG. 1. In the example of FIG. 1, an adjustable tray 102 is attached to a pivot housing 108 that disconnects and reconnects quickly and easily to a first end 228 of a support arm 104. The adjustable tray 102 may optionally be provided with an inset surface 236 for containing spills and preventing objects from sliding off the tray. The top surface 148 of the adjustable tray 102 may optionally be formed with a through-hole 124 for holding a beverage container such as a cup. A second end 230 of the support arm 104 comprises an armrest clamp 106 adapted for quickly and securely attaching to one armrest on a chair. The armrest clamp 106 includes two opposed pivoting clamp jaws (one clamp jaw 214 visible in FIG. 1) which may be deployed with the two clamp jaws oriented approximately parallel to one another for gripping opposite sides of an armrest on a chair or with the clamp jaws oriented approximately coplanar with one another for stowing and transporting the portable tray assembly 100. Each clamp jaw 214 may be locked in either a deployed or a stowed position by a clamp locking lever 212, one locking lever for each clamp jaw 214. In the example of FIG. 1, two locking levers 212 project vertically from the armrest clamp 106. In alternative embodiments of the invention, the locking levers may optionally be arranged to project horizontally from the armrest clamp.

The armrest clamp 106 may optionally be provided with one stationary clamp jaw and one traveling clamp jaw. A separation distance between the stationary clamp jaw and traveling clamp jaw may be adjusted by rotating a clamping ring 218 coupled to the support arm 104 and armrest clamp 106. Turning the clamping ring in one direction causes the traveling clamp jaw to move toward the stationary clamp jaw.

Turning the clamping ring in the opposite direction causes the traveling clamp jaw to move away from the stationary clamp jaw. After the traveling clamp jaw makes contact with a side of an armrest, the clamping ring 220 may be turned to increase clamping pressure against the armrest. A locking ring threadably engaged with the support arm 104 may be rotated until firm contact is established between the clamping ring and locking ring to prevent the clamp ring from rotating. Loosening the locking ring enables the clamping ring to be rotated and the armrest clamp to be disengaged from the armrest.

The adjustable tray 102 may be rotated relative to the support arm 104 by depressing a pivot pushbutton 112 retained in the pivot housing 108. Releasing the pushbutton 112 engages a clamp mechanism that holds the tray at a selected angle. A pair of opposing outer tray release pushbuttons 218, one of which is visible in FIG. 1, may be compressed toward one another to release the pivot housing 108 and its attached tray 102 from the first end 228 of the support arm 104. The tray 102 may then be lifted away from the chair without disengaging the armrest clamp and support arm from the armrest. The pivot housing may be reattached to the support arm by pressing the first end 228 of the support arm 104 into an aperture on the underside of the housing to re-engage a latch for holding the tray and support arm into a rigid assembly.

Figure 2:
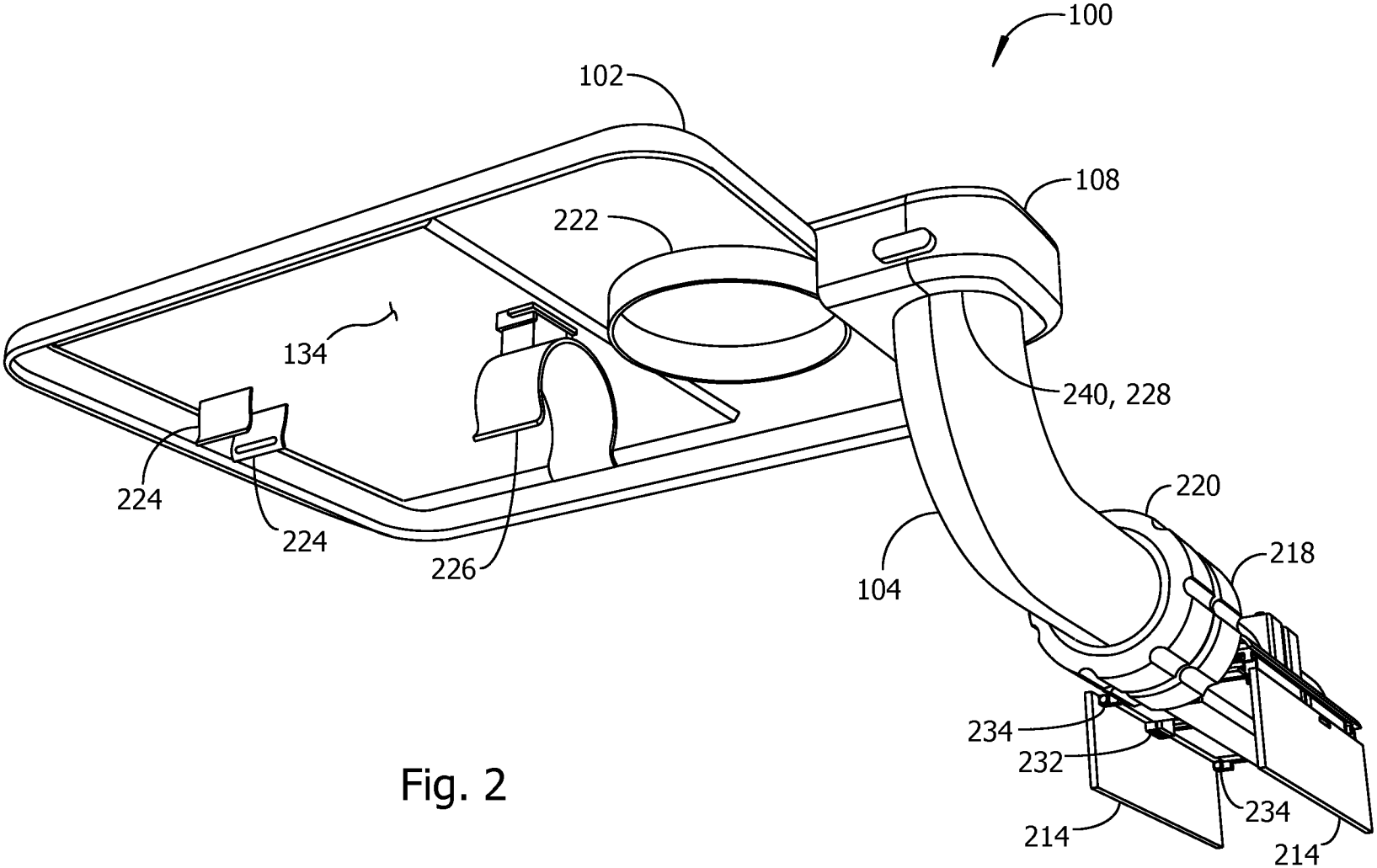
FIG. 2 is a pictorial view toward bottom side of the examples of an adjustable tray, support arm, and armrest clamp from FIG. 1.

FIG. 2 shows a view toward the underside of the portable tray assembly 100 from the example of FIG. 1. In the example of FIG. 2, the two clamp jaws 214 have been pivoted into their deployed position, with the two clamp jaws approximately parallel to one another and separated by a distance greater than a width of an armrest. Each clamp jaw 214 is coupled to the armrest clamp by a pair of hinges 234. A locking receiver 232 on an inside surface of each clamp jaw 214 receives an end of a clamp locking lever 212 to hold the clamp jaw in one of two selectable positions. Disengaging the end of the clamp locking lever 212 from the locking receiver 232 enables free rotation of a clamp jaw 214. Slidably engaging the end of a locking lever with its associated locking receiver prevents rotation of the clamp jaws relative to the support arm and holds the clamp jaws firmly in one of two selectable orientations, either deployed or stowed. Clamp jaws may be provided with flat surfaces as shown in the examples in the figures, or may alternatively be formed with ledges, steps, textures, or other features to help the clamp jaws grip an armrest securely and without damaging the armrest. A clamp jay may optionally include a compressible material on a side of the clamp jaw that grips an armrest.

A pair of clips for stowing the support arm 104 is provided on a bottom side 134 of the adjustable tray 102. A first support arm clip 226 is sized for gripping the support arm 104. The first support arm clip 226 may optionally be detachable from the bottom side 134 of the adjustable tray. A second support arm clip 224 may optionally be affixed to the tray or may alternately be detachable. The two clips cooperate to securely hold a support arm against the bottom side of the tray after the support arm has been disconnected from the pivot housing.

Stiffening ribs may optionally be formed on the adjustable tray to provide a lightweight, rigid assembly capable of supporting the weight of a seated person leaning on the tray, the weight of food items, and similar loads that may be expected in ordinary use. In FIG. 2, a cylindrical wall 222 located around the cup holder stiffens the adjustable tray and helps hold a cup inserted in the cup holder in an upright position.

Figure 3:
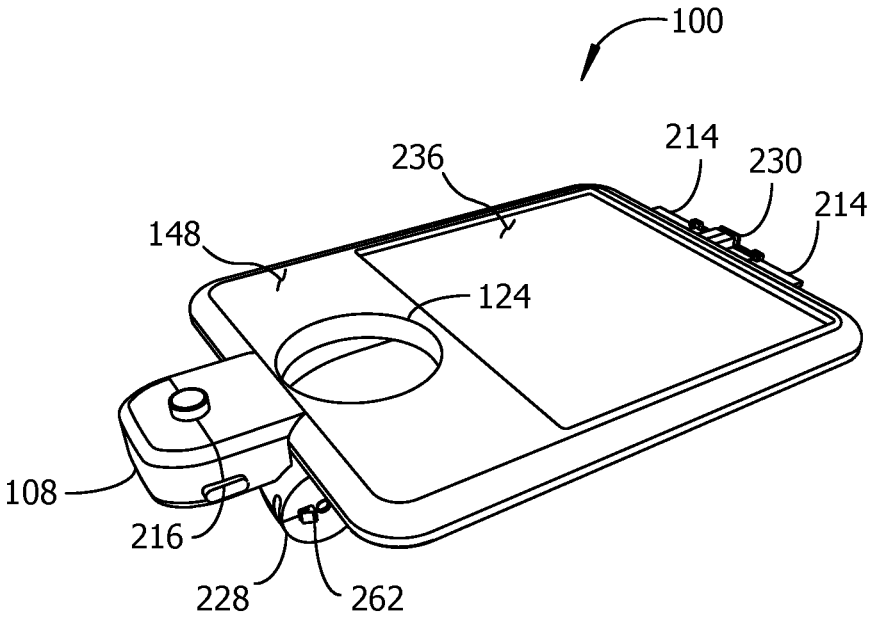
FIG. 3 is a pictorial view toward the top side the example of an adjustable tray from the previous figures, with the support arm detached from the tray and stowed beneath the tray.
Figure 4:
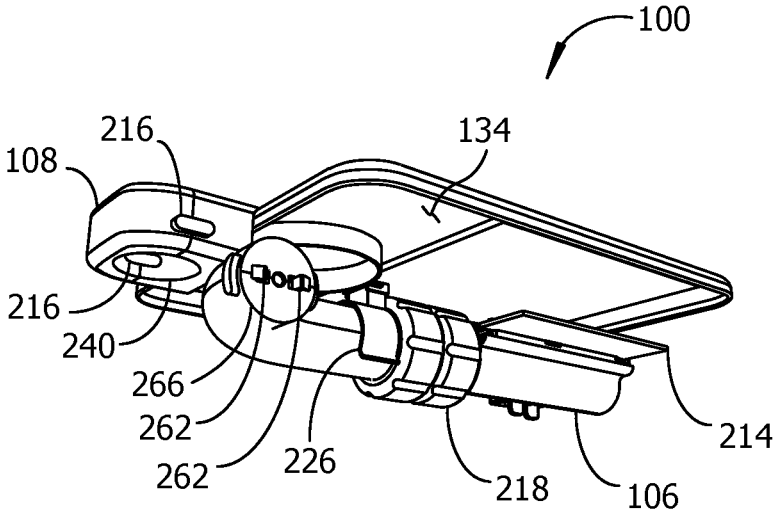
FIG. 4 is a pictorial view toward the bottom side of the tray and stowed support arm from of FIG. 3.

FIGS. 3-4 show views of an example of a portable tray assembly 100 with the support arm stowed against a bottom side 134 of the adjustable tray and retained in the removable support arm clip 226. In FIG. 3, the first end 228 of the support arm is partly visibly at one end of the tray and the second end 230 at the other end of the tray. Part of the support arm is visible through the cup holder aperture 124. The stowed support arm 104 may be seen more clearly in FIG. 4. A pair of opposing latch hooks 262 used to connect the support arm to the pivot housing protrudes through apertures formed in an end cap 266 on the first end of the support arm. One of the clamp jaws 214 may be seen in its stowed position after having been rotated away from the opposing clamp jaw and latched in place. A support arm aperture 240 for receiving the first end of the support arm is visible on a back side of the pivot housing 108. The opposing pair of outer tray release pushbuttons 216 are retained by and slidably engaged with the pivot housing 108.

Figure 5:
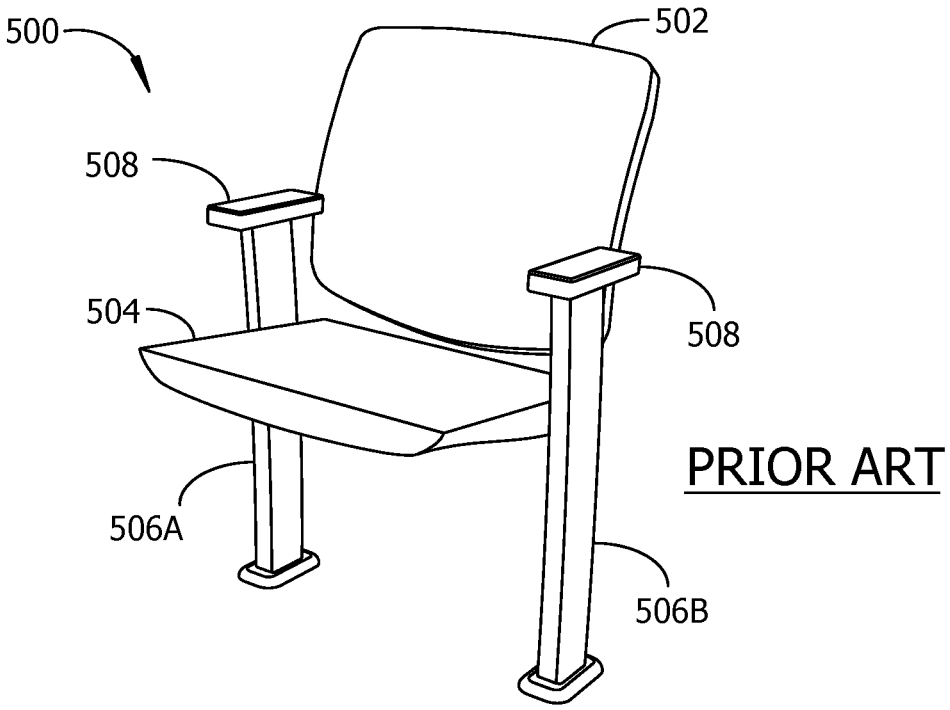
FIG. 5 is a pictorial view of an example of a chair suitable for use with an embodiment of the invention (PRIOR ART).

FIG. 5 shows a pictorial view toward the front side of an example of a stadium chair suitable for use with an embodiment of the invention. Embodiments of the invention do not include a chair. In the prior art example of a stadium chair 500 seatback 502 spans a pair of armrests 508. An armrest may be attached to a right side leg 506A and another armrest may be attached to a left side leg 506B. Adjacent chairs may share a leg and an armrest. Some stadium chairs have a seat bottom 504 which may be rotated toward the seatback 502.

Figure 6:
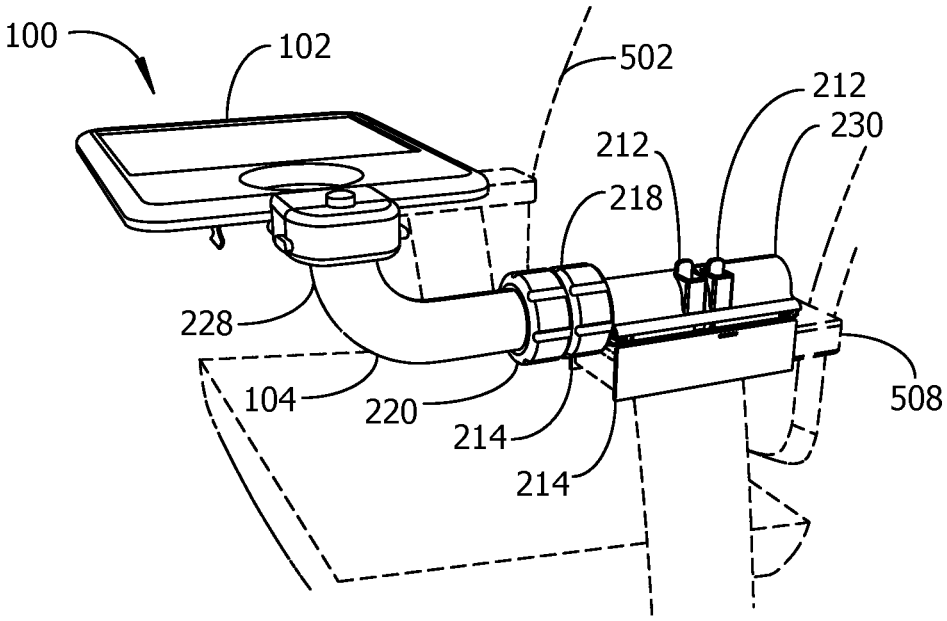
FIG. 6 is a partial pictorial view toward the left side of the example of a chair from FIG. 5, showing an example of a deployed position for an embodiment of the invention.

FIG. 6 illustrates an example of an embodiment of the invention 100 attached to an armrest 8 of a stadium chair. The clamp jaws 214 are shown in firm contact with the vertical sides of the armrest 508, gripping the armrest tightly and preventing the portable tray assembly 100 from slipping or falling off the chair. An overall length for the support arm 104 is preferably chosen to provide adequate space for a large adult to sit comfortably against the seatback 502 with the adjustable tray in front of him or her. In the example of FIG. 6, the portable tray assembly 100 is attached to the left armrest. However, the same portable tray assembly shown in the figure may be attached to the right armrest by attaching the armrest clamp to the armrest and rotating the adjustable tray 180 degrees from the orientation shown in the example of FIG. 5. Or, the tray could be left at the orientation shown in FIG. 5 and the portable tray assembly 100 attached to a right armrest to enable a person in an adjacent chair to use the tray.

Figure 7:
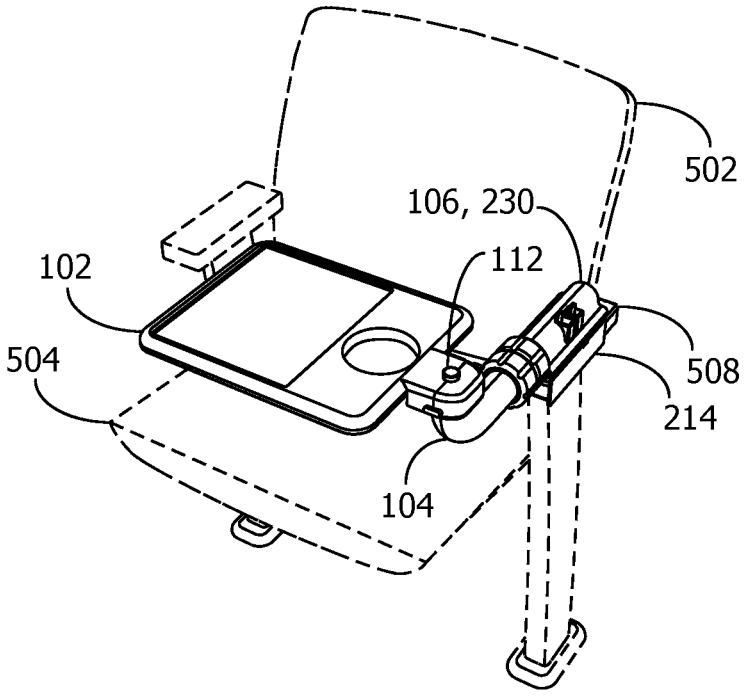
FIG. 7 is another pictorial view of an example of the invention attached to the left armrest of a chair, with an example of an adjustable tray at an approximately right angle to a support arm clamped to one armrest.
Figure 8:
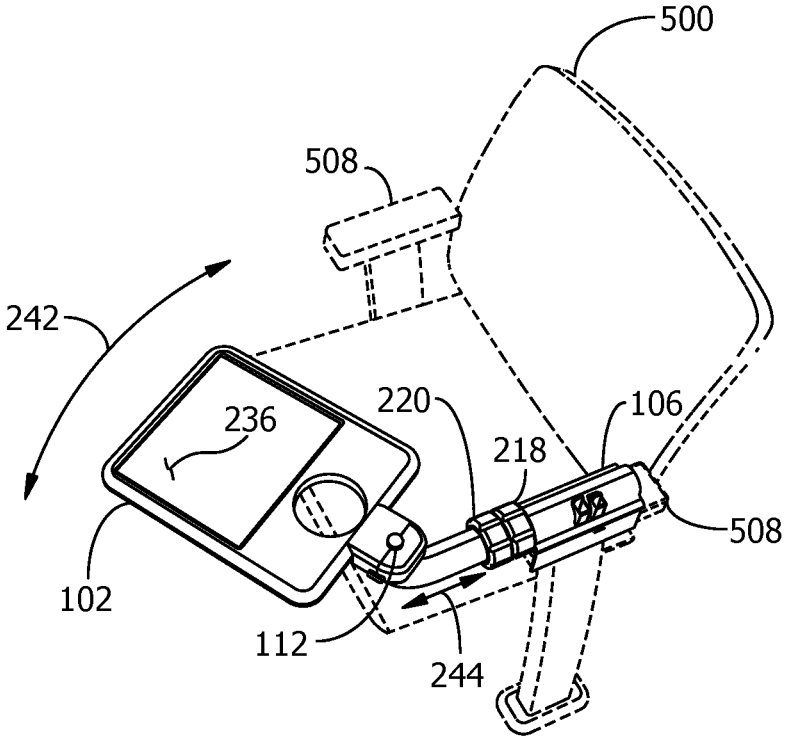
FIG. 8 continues the example of FIG. 7, showing the adjustable tray rotated about a pivot on the support arm and further showing the support arm extended further outward from the armrest than in FIG. 7.

FIG. 7 continues the example of FIGS. 5-6, showing the adjustable tray 102 at an approximately right angle to the right-side armrest 508. FIG. 8 shows the example of a portable tray assembly 100 and chair 500 from FIG. 7 with the tray rotated through an angle 242, pivoting from a point near the pushbutton 112. FIG. 8 further shows that some embodiments of the invention have a telescoping support arm for changing a distance by which the pivot housing extends away from the armrest. In the example of FIG. 8, the support arm has extended outward from the armrest clamp as suggested by arrows 244 indicating directions of retraction or extension.

Figure 9:
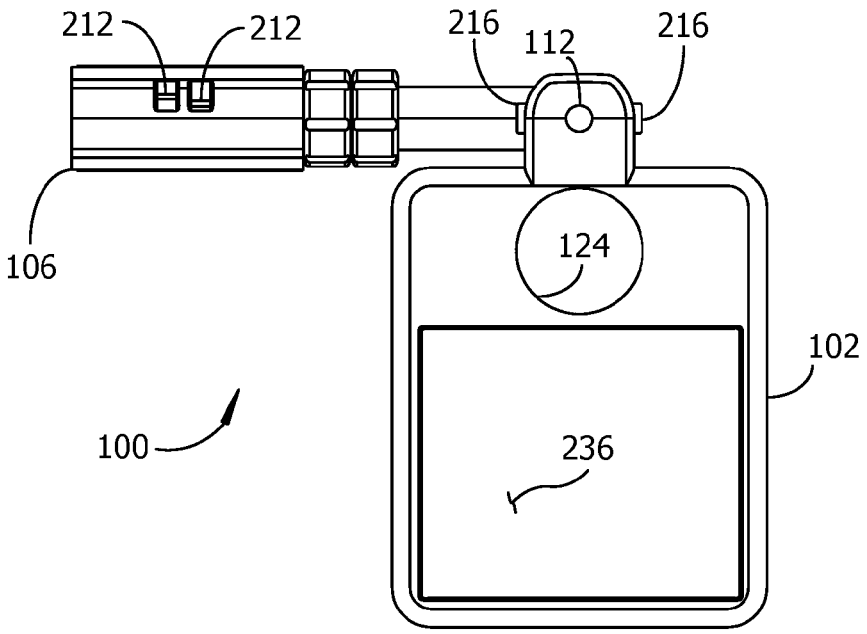
FIG. 9 is an orthographic projection toward the top side of an embodiment of the invention, showing an example of an adjustable tray at an approximately right angle to an example of a support arm.
Figure 10:
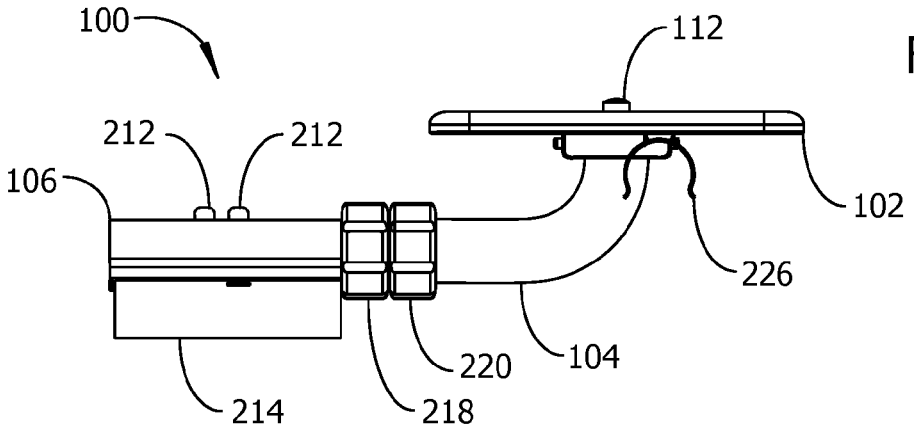
FIG. 10 is an orthographic projection toward a side of the example of FIG. 9, showing an approximately right angle bend in the support arm and a tray elevated above an armrest clamp.
Figure 11:
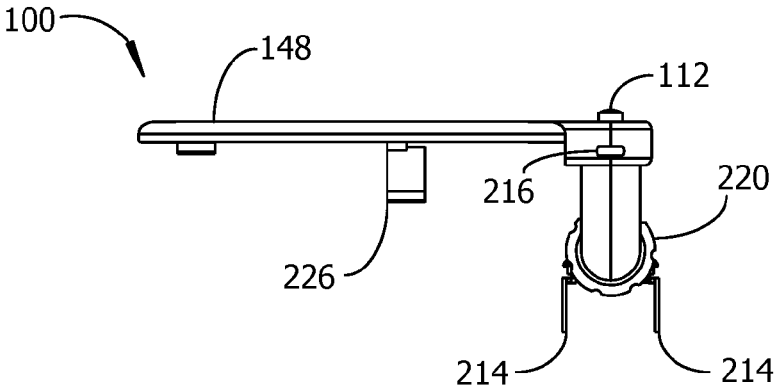
FIG. 11 is an orthographic projection toward an end of the support arm from the examples of FIGS. 9-10, showing an example of clamp jaws adjusted to a vertical position for gripping the sides of an armrest.

FIGS. 9-11 show orthographic projections of an example of a portable tray assembly 100 with the adjustable tray 102 positioned at an approximately right angle to the support arm 104 and the opposing clamp jaws pivoted into position for gripping an armrest. FIG. 10 shows that the support arm 104 may optionally be provided with an approximately right angle bend to elevate the bottom side of the adjustable tray to a convenient height for a seated person using the tray.

Figure 12:
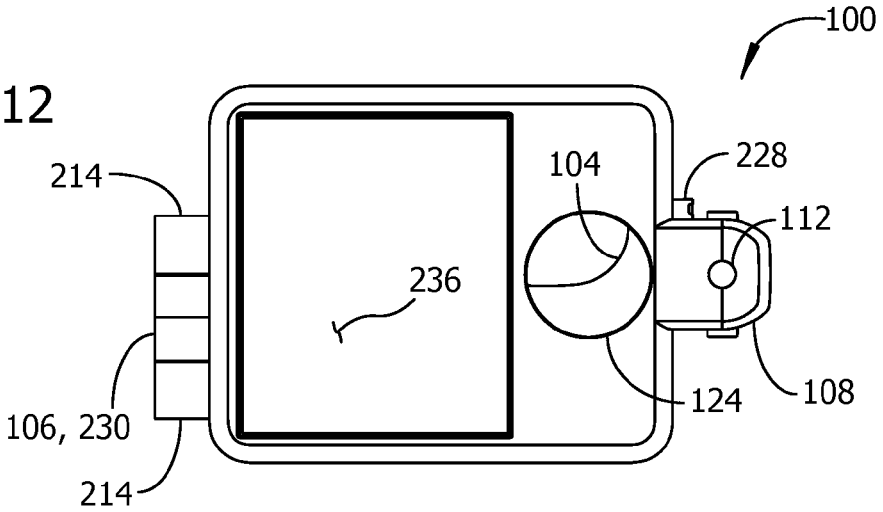
FIG. 12 is an orthographic projection toward the top of the example of an embodiment of the invention from FIGS. 9-11, but with the support arm detached and stowed beneath the adjustable tray.
Figure 13:
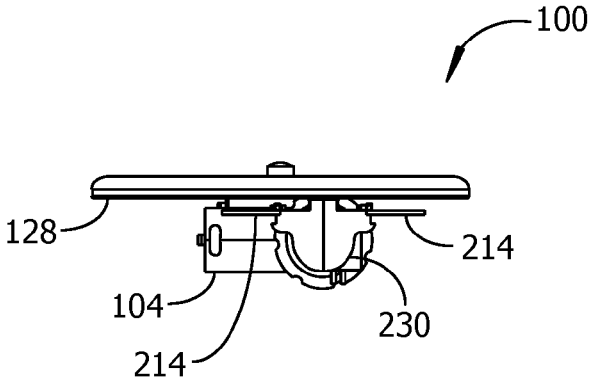
FIG. 13 is an orthographic projection toward an end of the stowed support arm from the example of FIG. 12, showing an example of the clamp jaws stowed approximately parallel to the back side of the adjustable tray.
Figure 14:
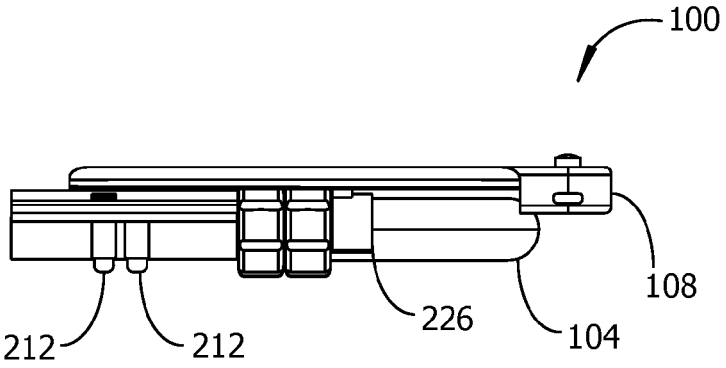
FIG. 14 is an orthographic projection toward a side of the examples of FIGS. 12-13.

FIGS. 12-14 show orthographic projections of the example of an adjustable tray from FIGS. 9-11, but with the support arm detached and stowed against the back side of the adjustable tray. The detached support arm 104 is retained against the back of the tray by the support arm clip 226. FIG. 13 shows that the clamp jaws 214 positioned to be approximately coplanar with one another to facilitate stowing the support arm against the tray and reduce an overall thickness of the combined tray and support arm.

Figure 15:
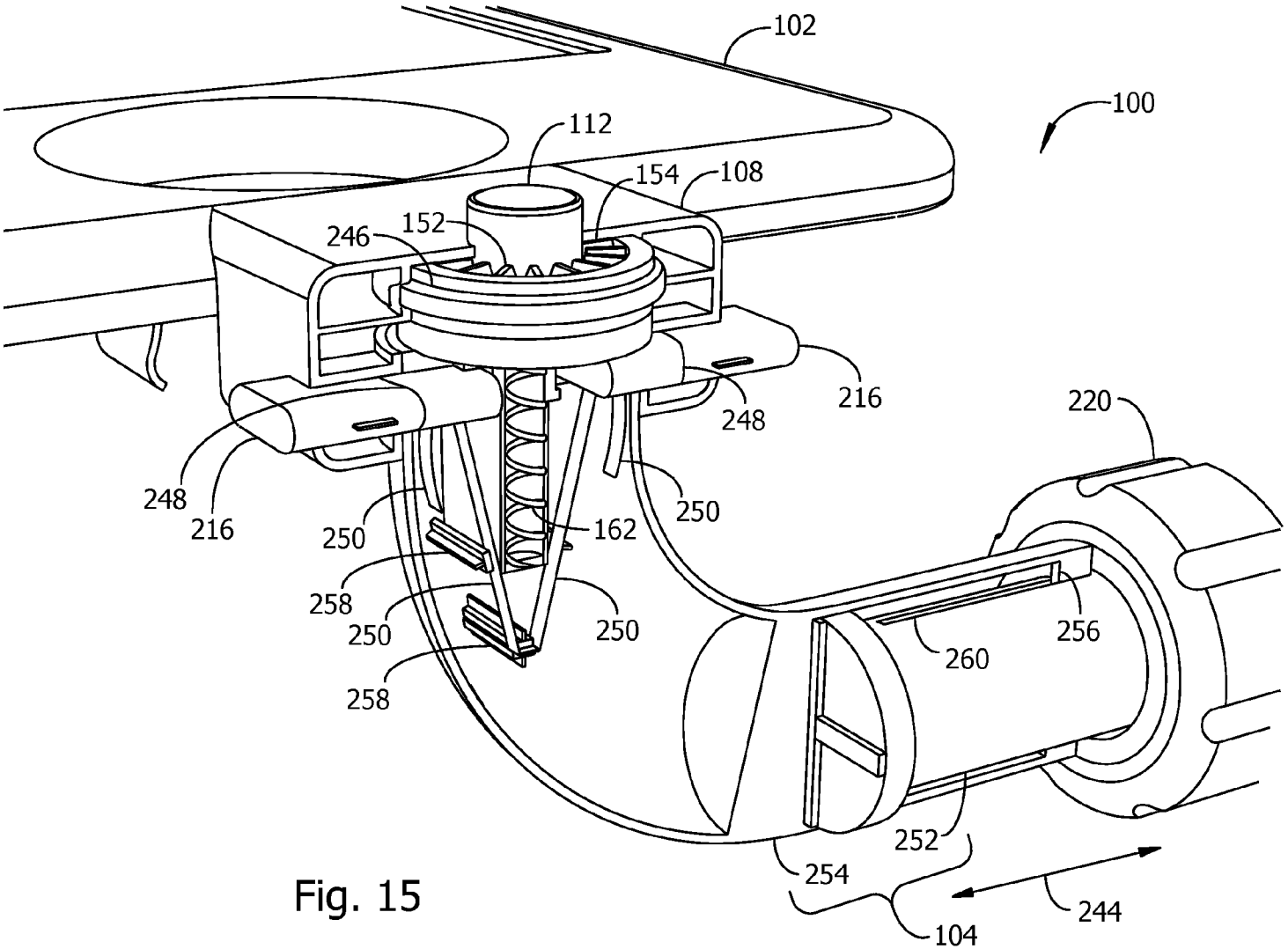
FIG. 15 is a partial pictorial view showing some details of an example of a tray rotation clamp, a tray release clamp, and an extendable support arm.

As suggested in the partial cutaway view in FIG. 15, an embodiment of the invention 100 may include a first clamping mechanism comprising an indexed pivot for rotating the tray and holding the tray firmly at a selected rotation angle relative to the support arm. A second clamping mechanism may be included for easy and secure connection and rapid, one-handed disconnection of the adjustable tray from the support arm. In the example of FIG. 15, part of the pivot housing 108 and part of the support arm 104 have been removed to show internal details. An example of an arm hub 246 is shown inside the pivot housing 108. When the pivot housing 108 and support arm 104 are connected to one another, the arm hub remains stationary relative to the support arm.

The arm hub 246 is rotatably coupled to and captured within the pivot housing 108. A lower index plate 152 comprising radial ridges projecting upward from a disk is attached to the pivot pushbutton 112 fits within and slidably engages the arm hub but does not rotate relative to the arm hub. An upper index plate 154 comprising radial ridges projecting downward from an upper interior surface of the pivot housing may be fixed to the pivot housing 108 or alternately may be formed as an integral part of the pivot housing. A pivot spring 162 urges the lower index plate 152 into contact with the upper index plate 154. When the two index plates are in contact with one another, the radial ridges on the two plates mesh with one another to prevent relative rotation between the plates, thereby preventing relative rotation between the pivot housing and arm hub. Since the arm hub is stationary compared to the support arm, the engaged index plates also prevent rotation of the adjustable tray relative to the support arm. Depressing the pivot pushbutton 112 slides the lower index plate within the arm hub, separating the lower index plate from the upper index plate and permitting the pivot housing to rotate relative to the arm hub and support arm. The adjustable tray 102 may rotate through a full circle around the arm hub, enabling an embodiment of the invention to be used on either the left armrest or right armrest.

FIG. 15 further illustrates some components for a second clamping mechanism for holding the pivot housing against the first end of the support arm. Two opposing outer tray release pushbuttons 216 slidably engage with the pivot housing 108. Two inner tray release pushbuttons 248 slidably engage with the support arm 104 near its first end 228. Two latch hooks, one on each inner tray release pushbutton, engage the lip of an aperture in the base of the arm hub, holding the pivot housing against the end of the support arm and the arm hub stationary relative to the support arm. The location and operation of the latch hooks will be explained below in relation to FIGS. 16-18. When the outer tray release pushbuttons 216 are aligned for contact with the inner tray release pushbuttons by rotating the pivot housing relative to the support arm, compressing the outer tray release pushbuttons toward one another also compresses the inner tray release pushbuttons from one another, forcing the latch hooks to release their contact with the arm hub and permitting the pivot housing and arm hub to be pulled away from the support arm. When the outer tray release pushbuttons are released, a tray release spring 250 supported spring posts 258 and coupled to both inner tray release pushbuttons urges the inner tray release pushbuttons outward. The latch hooks are also forced outward, and when the latch hooks contact the arm hub in the pivot receiver, the latch hooks engage the arm hub and hold the pivot hub stationary against the support arm.

In some embodiments of the invention, the support arm may telescope to change a separation distance between the first and second ends of the support arm. As shown in the example of FIG. 15, the support arm 104 may comprise an extendable arm 254 slidably coupled to a stationary arm 252. The clamping ring 220 and armrest clamp (not visible in FIG. 15) are attached to the stationary arm 252. An antirotation key 256 attached to an interior surface of the extendable arm 254 travels in a key slot 260 formed in the stationary arm. The key slot may optionally be formed with an opening partly around the circumference of the stationary arm (not illustrated) to permit the extendable arm to rotate through a quarter turn when the arms are retracted. In an alternative embodiment of the invention, a key ridge on the stationary arm slides between adjacent ridges formed on the inside of the extendable arm. The ridges may optionally be arranged to enable the extendable arm to rotate through a quarter turn when the arms are retracted. A direction of extension or retraction of the extendable arm relative to the stationary arm is marked by arrows 244.

Figure 16:
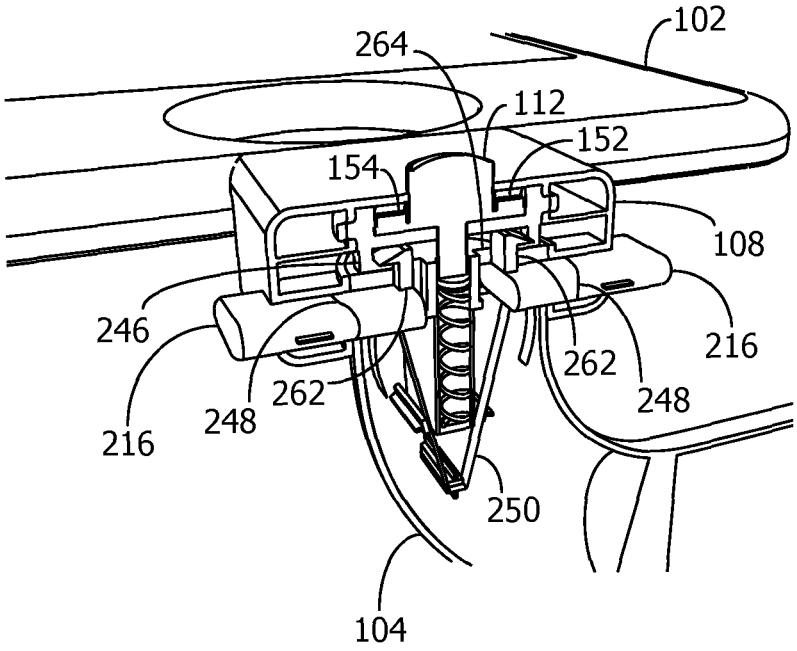
FIG. 16 is a partial pictorial view showing some internal details of a pivot housing from the example of FIG. 15, with an example of a tray release clamp in position to securely hold the adjustable tray to an end of the support arm.
Figure 17:
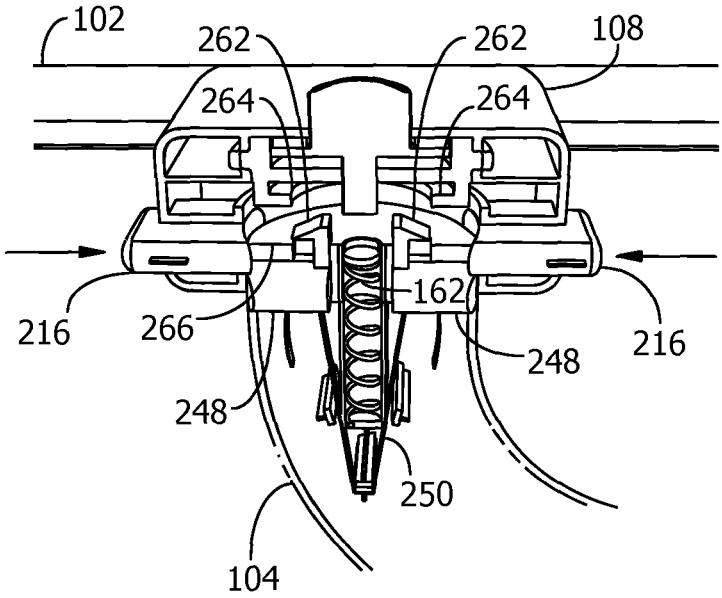
FIG. 17 continues the example of FIG. 16, showing an example of the tray release clamp activated to disengage the pivot housing from the end of the support arm.

Some additional details of the first and second clamps are shown in FIGS. 16-18. The pivot pushbutton 112 and its attached lower index plate 152 slide within the arm hub 246. In the example of FIG. 16, the lower index plate 152 and upper index plate 154 are engaged to prevent tray rotation relative to the arm hub. The arm hub 246 is formed with one or more apertures 264 for receiving latch hooks 262. The latch hooks 262 are attached to and move with the inner tray release pushbuttons 248 as previously explained. In FIG. 16, the tray release spring 250 has urged the pushbuttons all the way out, causing the latch hooks 262 to overlap an edge of the aperture 264 and hold the arm hub against the end of the support arm 104. In the example of FIG. 17, the outer tray release pushbuttons 216 have been compressed toward one another as suggested by the arrows, forcing the latch hooks away from the edges of an aperture 264 in the arm hub and permitting the pivot housing to be pulled vertically away from the end cap 266 of the support arm.

A vertical separation between the pivot housing and end cap is suggested by a vertical offset between the outer tray release pushbuttons 216 and inner tray release pushbuttons 248 in FIG. 17. The latch hooks 262 remain displaced from the edges of the aperture 264 in the arm hub until the outer tray release pushbuttons are no longer in contact with the inner tray release pushbuttons. Pressing the support arm into the pivot housing causes the angled tops of the latch hooks to re-engage the edges of the one or more apertures 264 in the arm hub and hold the pivot housing against the first end of the support arm. FIG. 18 gives a view of the latch hooks 262 protruding through apertures in the end cap 266 of the support arm 104.

An example of an armrest clamp appears in FIGS. 19-22. In FIG. 19, the armrest clamp 106 is at the second end 230 of the support arm 104. Two clamp jaws 214 are shown in a vertical orientation for clamping against an armrest, one of two selectable orientations for each clamp jaw. Two clamp locking levers 212 protrude from the top side of the armrest clamp, although the levers may be positioned differently in alternative embodiments of the invention.

Figure 20:
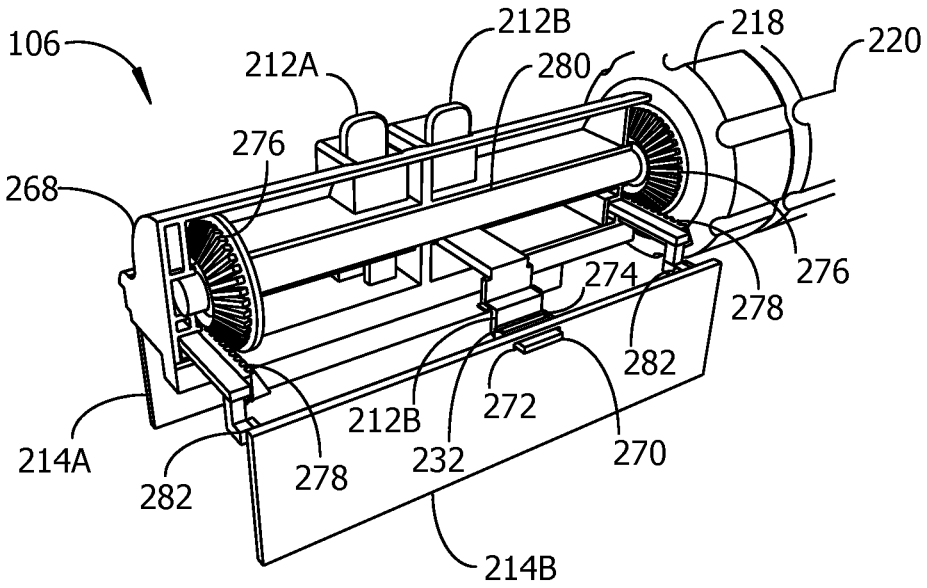
FIG. 20 is a partial pictorial view of an example of an armrest clamp.
Figure 21:
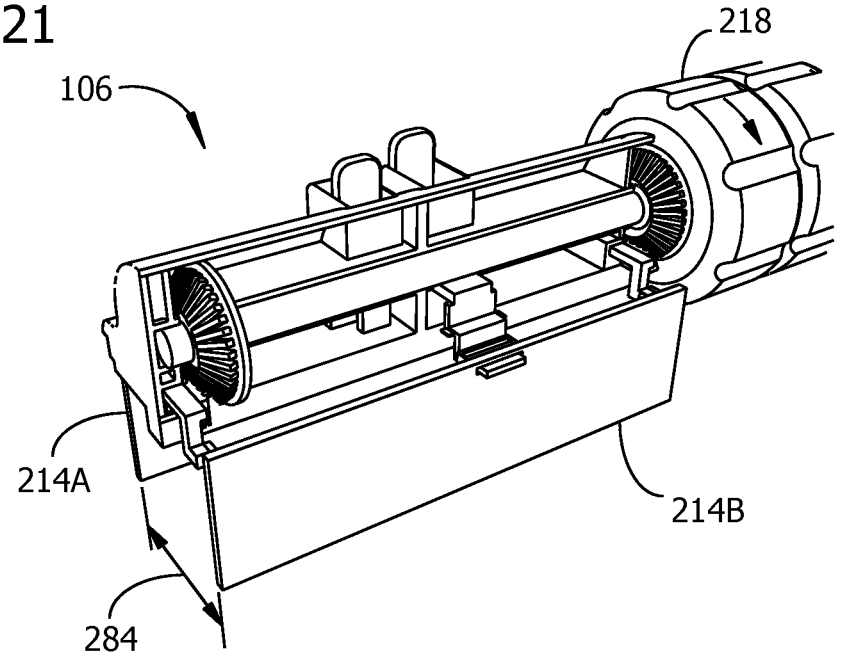
FIG. 21 continues the example of FIG. 20, showing an example of a traveling clamp jaw in a partially retracted position compared to FIG. 20.

FIG. 20 shows the armrest clamp 106 from the example of FIG. 19 with part of an armrest clamp cover 268 removed. In the example of FIG. 20, the clamping ring 218 is connected to a drive shaft 280 rotatably coupled to the armrest clamp cover 268. Two bevel gears 276 are attached to the drive shaft 280 and are driven in rotation by rotation of the clamping ring 218. Each bevel gear drives a rack gear 278 to convert the rotary motion of the clamping ring 218 to a lateral displacement of the traveling clamp jaw 214B. Rotating the clamping ring in one direction pushes the traveling clamp jaw 214B away from the stationary clamp jaw 214A. Rotating the clamp ring in an opposite direction pushes the traveling clamp jaw 214B toward the stationary clamp jaw 214A. Rotation of the clamping ring 218 may be prevented by rotating the locking ring 220 until the locking ring comes into firm contact with the clamping ring. FIG. 20 shows an example of the traveling clamp jaw 214B extended laterally away from the stationary clamp jaw 214A. FIG. 21 shows an example of the traveling clamp jaw 214B retracted laterally toward the stationary clamp jaw 214A, reducing a lateral separation distance 284 between the clamp jaws compared to their positions in FIG. 20

The traveling clamp jaw 214B is rotatably coupled to the two rack gears 278 by jaw pivots 282. A clamp locking lever 212B slidably coupled to the armrest clamp cover 268 includes an end tab 270 sized for a sliding fit into a selected one of two apertures in a locking receiver 232 attached to the traveling clamp jaw 214B. A second locking lever 212A has an end tab that fits into apertures in a locking receiver on the stationary clamp jaw 214A. When the clamp jaw is vertical, the end tab of a locking lever engages a jaw deployment aperture 272 with a sliding fit, preventing rotation of the clamp jaw relative to the rack gear to which the clamp jaw is attached. When the clamp jaw is horizontal, the end tab of the locking lever engages a jaw stowing aperture 274, holding the jaw parallel to the back of the adjustable tray when the support arm is stowed against the tray.

Figure 22:
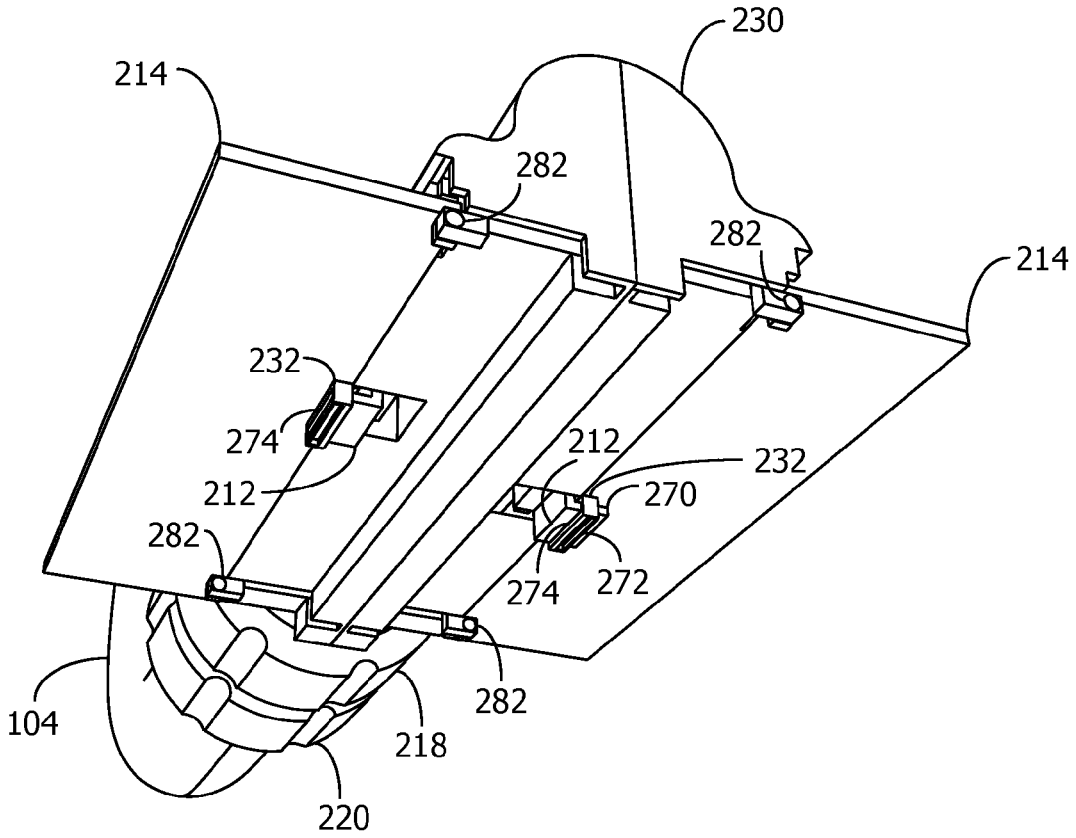
FIG. 22 is a partial pictorial view toward the bottom side of an example of an armrest clamp, showing clamp jaws latched in a stowed position.

FIG. 22 illustrates an example of the two clamp jaws 214 locked in a stowed position approximately coplanar with one another. Clamp jaws 214 are free to rotate at jaw pivots 282 until and end tab 270 on a clamp locking lever 212 fits into one of two apertures in a locking receiver 232, either a jaw stowing aperture 274 as in the example of FIG. 22 or a jaw deployment aperture 274 as in the example of FIG. 20.

Unless expressly stated otherwise herein, ordinary terms have their corresponding ordinary meanings within the respective contexts of their presentations, and ordinary terms of art have their corresponding regular meanings.

What is claimed is:

1. An apparatus, comprising:
- a tray;
- a pivot housing attached to said tray, comprising an arm hub rotatably coupled to said pivot housing;
- an armrest clamp comprising:
  - a clamping ring;
  - a stationary clamp jaw; and
  - a traveling clamp jaw driven in linear displacement relative to said stationary clamp by rotation of said clamping ring; and
- a support arm comprising:
  - an end cap at a first end of said support arm;
  - a latch extending outward from said end cap; and
  - a tray release pushbutton attached to said latch,
- wherein:
  - said latch holds said arm hub stationary against said end cap when said support arm is connected to said pivot housing;
  - depressing said tray release pushbutton disengages said latch from said arm hub; and
  - disengaging said latch from said arm hub disconnects said pivot housing from said support arm.

2. The apparatus of claim 1, wherein said pivot housing further comprises:
- a pivot pushbutton;
- a lower index plate attached to said pivot pushbutton and slidably coupled to said arm hub; and
- an upper index plate attached to said pivot housing.

3. The apparatus of claim 2, wherein said lower index plate is restrained from rotating relative to said arm hub.

4. The apparatus of claim 2, wherein said tray is restrained from rotating relative to said support arm when said lower index plate is in contact with said upper index plate.

5. The apparatus of claim 2, wherein said support arm further comprises a pivot spring disposed to press against said pivot pushbutton when said pivot housing is attached to said support arm.

6. The apparatus of claim 5, wherein said pivot spring urges said lower index plate toward said upper index plate, thereby holding said lower index plate against said upper index plate and restraining rotation of said tray relative to said support arm.

7. The apparatus of claim 1, wherein:
- said tray release pushbutton comprises a first inner tray release pushbutton;
- said latch comprises a first latch attached to said first inner tray release pushbutton;
- said pivot housing further comprises:
  - a first outer tray release pushbutton slidably engaged with said pivot housing; and
  - a second outer tray release pushbutton slidably engaged with said pivot housing; and
- said support arm further comprises:
  - a second of said latch attached to a second inner tray release pushbutton; and
  - a tray release spring attached to said support arm and to said first and second inner tray release pushbuttons, said tray release spring disposed to urge said first and second tray release pushbuttons away from one another.

8. The apparatus of claim 7, wherein said first and second inner tray release pushbuttons are displaced toward one another by a corresponding displacement of said first and second outer tray release pushbuttons.

9. The apparatus of claim 1, wherein said latch holds said pivot housing against said support arm by overlapping an edge of an aperture formed in said arm hub.

10. The apparatus of claim 1, wherein said support arm further comprises:
- an extendable arm;
- a stationary arm attached to said armrest clamp and slidably coupled to said extendable arm; and
- an antirotation key coupling said extendable arm to said stationary arm.

11. The apparatus of claim 1, further comprising a locking ring threadably coupled to said support arm, wherein rotating said locking ring until said locking ring presses against said clamping ring prevents rotation of said clamping ring.

12. The apparatus of claim 1, wherein said armrest clamp further comprises:
- an armrest clamp housing;
- a drive shaft attached to said clamping ring and rotatably coupled to said armrest clamp housing;
- a first bevel gear attached to a first end of said drive shaft; and
- a first rack gear slidably coupled to said armrest clamp housing and driven by said first bevel gear,
- wherein said traveling clamp jaw is attached to said first rack gear and rotation of said clamping ring drives said first bevel gear in rotation and causes said first rack gear to laterally displace said traveling clamp jaw relative to said stationary clamp jaw.

13. The apparatus of claim 12, wherein said armrest clamp further comprises:

a second bevel gear attached to a second end of said drive shaft; and a second rack gear slidably coupled to said armrest clamp housing and driven by said second bevel gear, wherein said traveling clamp jaw is attached to said second rack gear and rotation of said clamping ring drives said second bevel gear in rotation and causes said first rack gear and said second rack gear to laterally displace said traveling clamp jaw relative to said stationary clamp jaw.

14. The apparatus of claim 1, wherein said support arm is rotatable through a quarter turn relative to said armrest clamp.

15. The apparatus of claim 1, wherein said stationary clamp jaw and said traveling clamp jaw each further comprise a locking receiver having a jaw deployment aperture formed in a first side of said locking receiver and a jaw stowing aperture formed in a second side adjacent to said first side.

16. The apparatus of claim 15, wherein said armrest clamp further comprises a first clamp locking lever slidably coupled to said armrest clamp and said first clamp locking lever comprises an end tab sized for a sliding fit into said jaw deployment aperture and said jaw stowing aperture on said traveling clamp jaw.

17. The apparatus of claim 16, wherein said traveling clamp jaw is prevented from rotating relative to said armrest clamp when said end tab of said first clamp locking lever engages said jaw deployment aperture on said traveling clamp jaw.

18. The apparatus of claim 16, wherein said traveling clamp jaw is prevented from rotating relative to said armrest clamp when said end tab of said first clamp locking lever engages said jaw stowing aperture on said traveling clamp jaw.

19. The apparatus of claim 16, wherein said armrest clamp further comprises a second clamp locking lever slidably coupled to said armrest clamp and said second clamp locking lever comprises an end tab sized for a sliding fit into said jaw deployment aperture and said jaw stowing aperture on said stationary clamp jaw.

20. The apparatus of claim 19, wherein said stationary clamp jaw is prevented from rotating relative to said armrest clamp when said end tab of said second clamp locking lever engages said jaw deployment aperture on said stationary clamp jaw.

* * * * *